US008049695B2

(12) United States Patent
Ozawa et al.

(10) Patent No.: US 8,049,695 B2
(45) Date of Patent: Nov. 1, 2011

(54) CORRECTION OF VISIBLE MURA DISTORTIONS IN DISPLAYS BY USE OF FLEXIBLE SYSTEM FOR MEMORY RESOURCES AND MURA CHARACTERISTICS

(75) Inventors: Yasuo Ozawa, Vancouver, WA (US); Scott J. Daly, Kalama, WA (US); Xiao-Fan Feng, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 875 days.

(21) Appl. No.: 12/008,470

(22) Filed: Jan. 11, 2008

(65) Prior Publication Data

US 2009/0096729 A1 Apr. 16, 2009

Related U.S. Application Data

(60) Provisional application No. 60/999,152, filed on Oct. 15, 2007.

(51) Int. Cl.
*G09G 3/36* (2006.01)

(52) U.S. Cl. ..... 345/87; 345/88; 345/89; 345/98; 345/102

(58) Field of Classification Search ..... 345/3.4, 345/76, 87–89, 98, 102, 204, 207, 428, 581, 345/601, 617; 382/254, 149, 141; 348/180, 348/181, 191; 349/37, 96, 102, 106, 119, 349/192

See application file for complete search history.

(56) References Cited

U.S. PATENT DOCUMENTS

| | | | | |
|---|---|---|---|---|
| 5,917,935 | A * | 6/1999 | Hawthorne et al. | 382/149 |
| 6,700,559 | B1 * | 3/2004 | Tanaka et al. | 345/88 |
| 7,623,216 | B2 * | 11/2009 | Hwang | 349/192 |
| 7,876,403 | B2 * | 1/2011 | Fukuda et al. | 349/96 |
| 2003/0214586 | A1 * | 11/2003 | Lee et al. | 348/180 |
| 2004/0213449 | A1 * | 10/2004 | Safaee-Rad et al. | 382/141 |
| 2005/0007392 | A1 | 1/2005 | Kasai et al. | |
| 2005/0099431 | A1 * | 5/2005 | Herbert et al. | 345/601 |
| 2006/0034536 | A1 * | 2/2006 | Ogren et al. | 382/254 |
| 2007/0091042 | A1 * | 4/2007 | Chung et al. | 345/88 |
| 2007/0109245 | A1 * | 5/2007 | Hwang | 345/98 |
| 2007/0126758 | A1 | 6/2007 | Hwang | |
| 2007/0126975 | A1 | 6/2007 | Choi et al. | |

(Continued)

FOREIGN PATENT DOCUMENTS

EP 1 211 661 6/2002

(Continued)

OTHER PUBLICATIONS

Japanese Office Action dated Nov. 18, 2008 for Japanese patent application No. 2008-072423 with English translation, 7 pages.

(Continued)

*Primary Examiner* — Prabodh M Dharia
(74) *Attorney, Agent, or Firm* — Chernoff Vilhauer McClung & Stenzel LLP

(57) ABSTRACT

A display that includes at least one gray level being provided to a plurality of pixels that illuminates each of the pixels with the gray level. The display applies interpolated corrective data for the pixels so as to reduce the mura effects of said display for those characteristics generally visible by the human visual system and so as not to reduce the mura effects of the display for those characteristics generally not visible by the human visual system.

20 Claims, 10 Drawing Sheets

Block diagram of flexible mura correction system

U.S. PATENT DOCUMENTS

| | | | | |
|---|---|---|---|---|
| 2007/0132661 | A1* | 6/2007 | Shen et al. | 345/3.4 |
| 2007/0182808 | A1* | 8/2007 | Stiblert et al. | 347/225 |
| 2007/0188591 | A1* | 8/2007 | Sandstrom | 347/248 |
| 2008/0032066 | A1* | 2/2008 | Stiblert et al. | 427/595 |
| 2008/0238934 | A1* | 10/2008 | Daly et al. | 345/617 |
| 2009/0028423 | A1* | 1/2009 | Sandstrom et al. | 382/149 |
| 2010/0013750 | A1* | 1/2010 | Kerofsky et al. | 345/89 |
| 2010/0013751 | A1* | 1/2010 | Kerofsky et al. | 345/89 |
| 2010/0240056 | A1* | 9/2010 | Henrich, III | 435/6 |
| 2011/0012908 | A1* | 1/2011 | Daly | 345/581 |

FOREIGN PATENT DOCUMENTS

| | | |
|---|---|---|
| EP | 1 650 730 | 4/2006 |
| JP | 2005-17715 | 1/2005 |
| JP | 2005-017715 | 1/2005 |
| JP | 2006-030362 | 2/2006 |
| JP | 2006-84729 | 3/2006 |
| JP | 2006-084729 | 3/2006 |
| JP | 2006-195444 | 7/2006 |
| JP | 2007-212996 | 8/2007 |
| WO | WO 93/19453 | 9/1993 |
| WO | WO 97/00452 | 1/1997 |
| WO | WO 2004/047058 | 6/2004 |

OTHER PUBLICATIONS

International Search Report and written opinion of the International Searching Authority dated Jan. 20, 2009 for International application No. PCT/JP2008/068926, 9 pages.

* cited by examiner

Modern LCD display and sources of Mura

Capturing Mura tonescale via brute-force method

Loading correction Mura tonescales in to display memory
(brute-force method)

Using the display for normal input imagery and the loaded Mura correction tonescale LUT. (brute-force method)

CSF dependence on viewing angle.
Measurements by Carlson[6] at a luminance of 108cd/m$^2$.

CSF of the human visual system

Using a 2D CSF model to attenuate the Mura correction for maintaining a higher dynamic range after correction Example signal effects of invention:
left = brute force method and loss of dynamic range,
right = CSF-filtered approach Original luminance (no correction)

Brute-force correction

Single image correction

Δcv curve of single image correction

Δcv curve of brute-force correction

Original luminance (no correction)

Multiple image correction (e.g. target gray scale = 2)

Δcv curve of multiple image correction

Block diagram of flexible mura correction system

CORRECTION OF VISIBLE MURA DISTORTIONS IN DISPLAYS BY USE OF FLEXIBLE SYSTEM FOR MEMORY RESOURCES AND MURA CHARACTERISTICS

CROSS-REFERENCE TO RELATED APPLICATIONS

This application is related to Ser. No. 11/731,094 filed Mar. 29, 2007.

The present application claims the benefit of 60/999,152 filed Oct. 15, 2007.

BACKGROUND OF THE INVENTION

The present invention relates to a system for reducing mura defects in a displayed image in an efficient manner.

The number of liquid crystal displays, electroluminescent displays, organic light emitting devices, plasma displays, and other types of displays are increasing. The increasing demand for such displays has resulted in significant investments to create high quality production facilities to manufacture high quality displays. Despite the significant investment, the display industry still primarily relies on the use of human operators to perform the final test and inspection of displays. The operator performs visual inspections of each display for defects, and accepts or rejects the display based upon the operator's perceptions. Such inspection includes, for example, pixel-based defects and area-based defects. The quality of the resulting inspection is dependent on the individual operator which are subjective and prone to error.

"Mura" defects are contrast-type defects, where one or more pixels is brighter or darker than surrounding pixels, when they should have uniform luminance. For example, when an intended flat region of color is displayed, various imperfections in the display components may result in undesirable modulations of the luminance. Mura defects may also be referred to as "Alluk" defects or generally non-uniformity distortions. Generically, such contrast-type defects may be identified as "blobs", "bands", "streaks", etc. There are many stages in the manufacturing process that may result in mura defects on the display.

Mura defects may appear as low frequency, high-frequency, noise-like, and/or very structured patterns on the display. In general, most mura defects tend to be static in time once a display is constructed. However, some mura defects that are time dependent include pixel defects as well as various types of non-uniform aging, yellowing, and burn in. Display non-uniformity deviations that are due to the input signal (such as image capture noise) are not considered mura defects.

Referring to FIG. 1, mura defects from an input image 170 which is adjusted in its tone scale 160 may occur as a result of various components of the display. The combination of the light sources (e.g., fluorescent tubes or light emitting diodes) and the diffuser 150 results in very low frequency modulations as opposed to a uniform field in the resulting displayed image. The LCD panel itself may be a source of mura defects because of non-uniformity in the liquid crystal material deposited on the glass. This type of mura tends to be low frequency with strong asymmetry, that is, it may appear streaky which has some higher frequency components in a single direction. Another source of mura defects tends to be the driving circuitry 120, 130, 140 (e.g., clocking noise) which causes grid like distortions on the display. Yet another source of mura defects is pixel noise, which is primarily due to variations in the localized driving circuitry (e.g., the thin film transistors) and is usually manifested as a fixed pattern noise.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
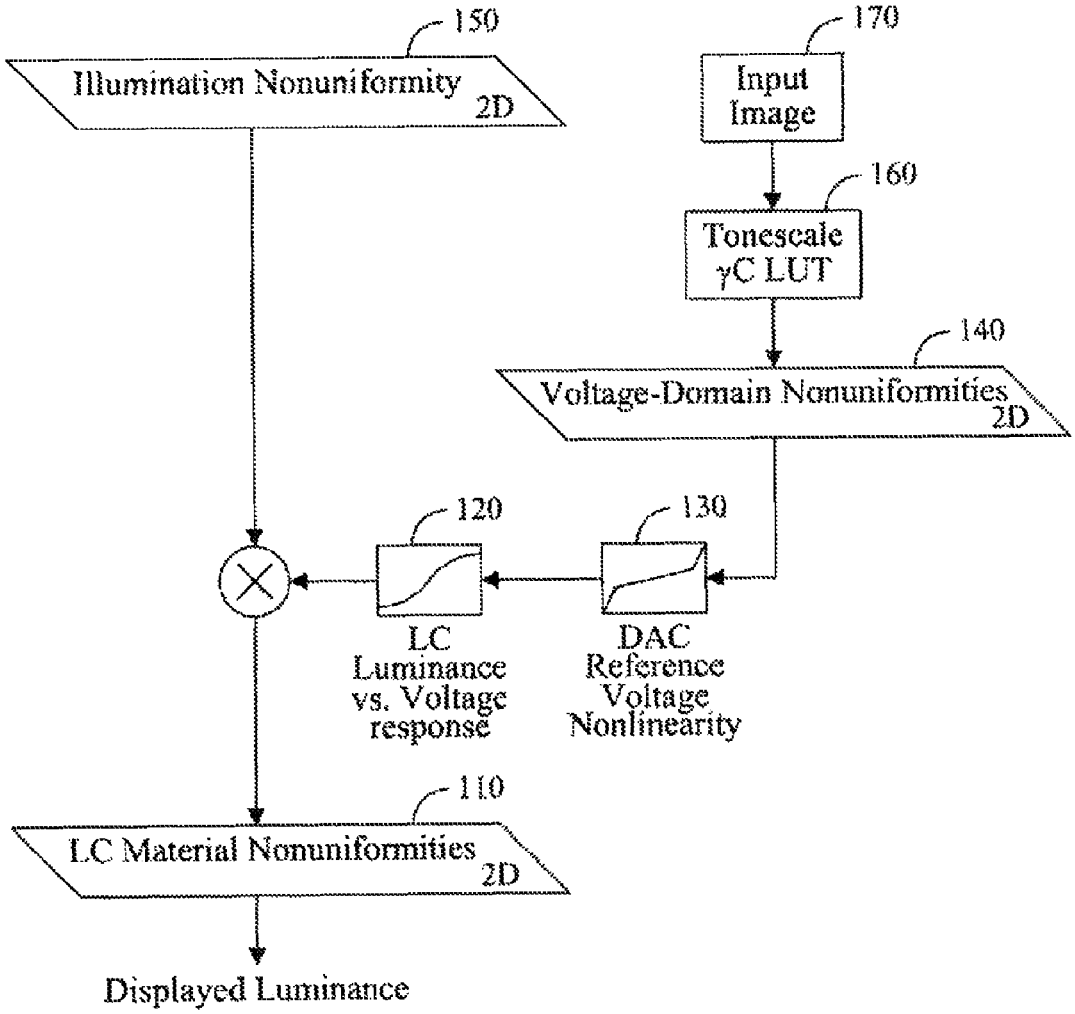
FIG. 1 PRIOR ART
FIG. 1 illustrates liquid crystal devices and sources of mura.

The continual quality improvement in display components reduces mura defects but unfortunately mura defects still persist even on the best displays. Referring to FIG. 1, identification of mura defects is not straightforward because the source of the mura arise in different luminance domains. The mura resulting from the illumination source occurs in the linear luminance domain. To compensate for this effect from the linear domain, the LCD luminance image is divided by the mura and then re-normalized to the desired maximum level. This effect in the linear domain may also be compensated by addition in the log domain. Unfortunately, the data displayed on the image domain of the image in the LCD code value space is neither linear nor log luminance. Accordingly, for correction of illumination-based mura, the LCD image data should be converted to either of these domains for correction.

The mura defects due to the thin film transistor noise and driver circuits does not occur in the luminance domain, but rather occurs in the voltage domain. The result manifests itself in the LCD response curse which is usually an S-shaped function of luminance.

Variations in the mura effect due to variations in liquid crystal material occur in yet another domain, depending on if it is due to thickness of the liquid crystal material, or due to its active attenuation properties changing across the display.

Rather than correct for each non-uniformity in their different domains, a more brute-force approach is to measure the resulting tone scale for each pixel of the display. The low frequency mura non-uniformities as well as the higher frequency fixed pattern mura non-uniformity will appear as distortions in the displayed tone scale. For example, additive distortions in the code value domain will show up as vertical offsets in the tone scale's of the pixels affected by such a distortion. Illumination based distortions which are additive in the log domain will show up as non-linear additions in the tone scale. By measuring the tone scale per pixel, where the tone scale is a mapping from code value to luminance, the system may reflect the issues occurring in the different domains back to the code value domain. If each pixel's tonescale is forced to be identical (or substantially so), then at each gray level all of the pixels will have the same luminance (or substantially so), thus the mura will be reduced to zero (or substantially so).

Figure 2:
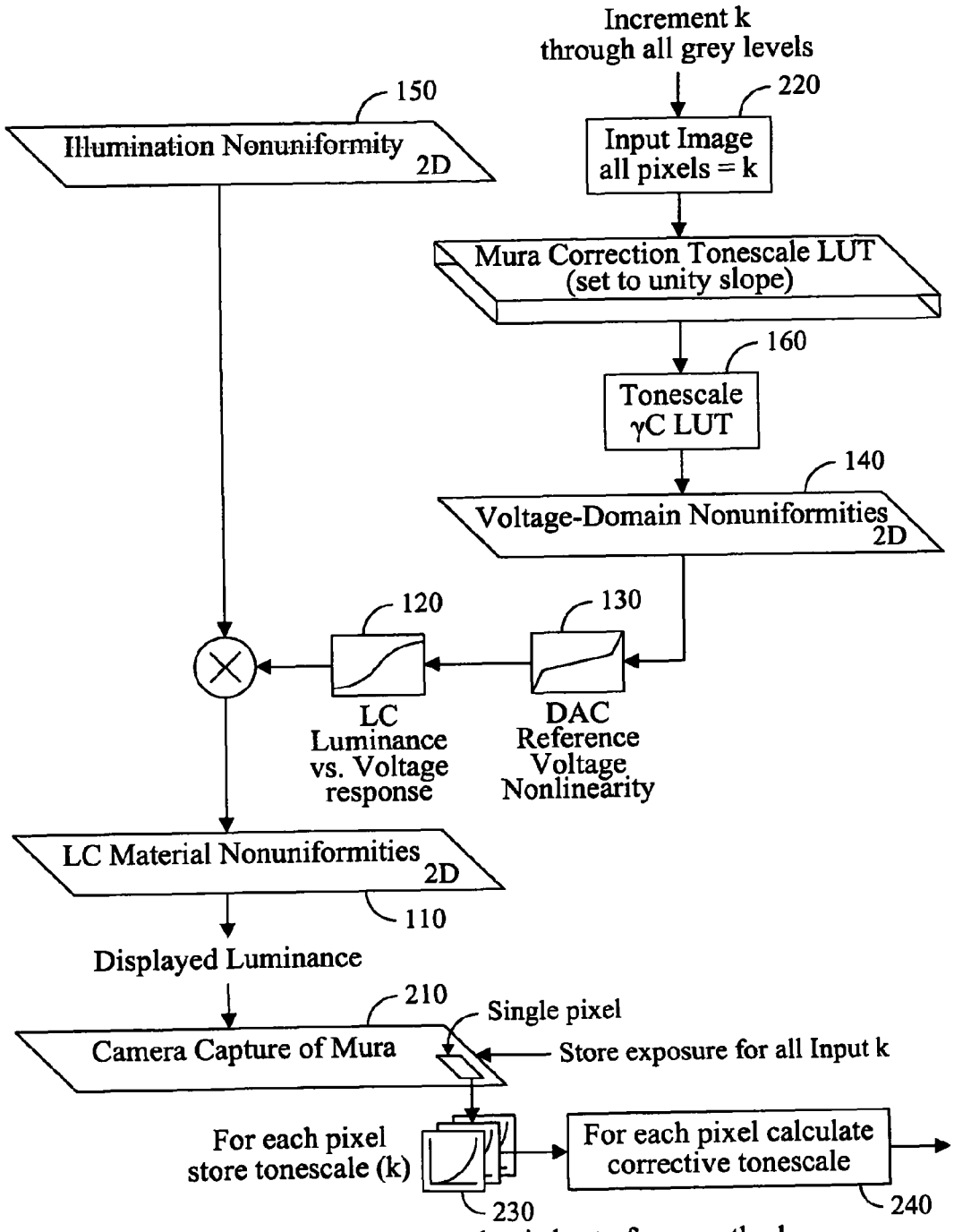
FIG. 2 illustrates capturing mura tonescale.
Figure 3:
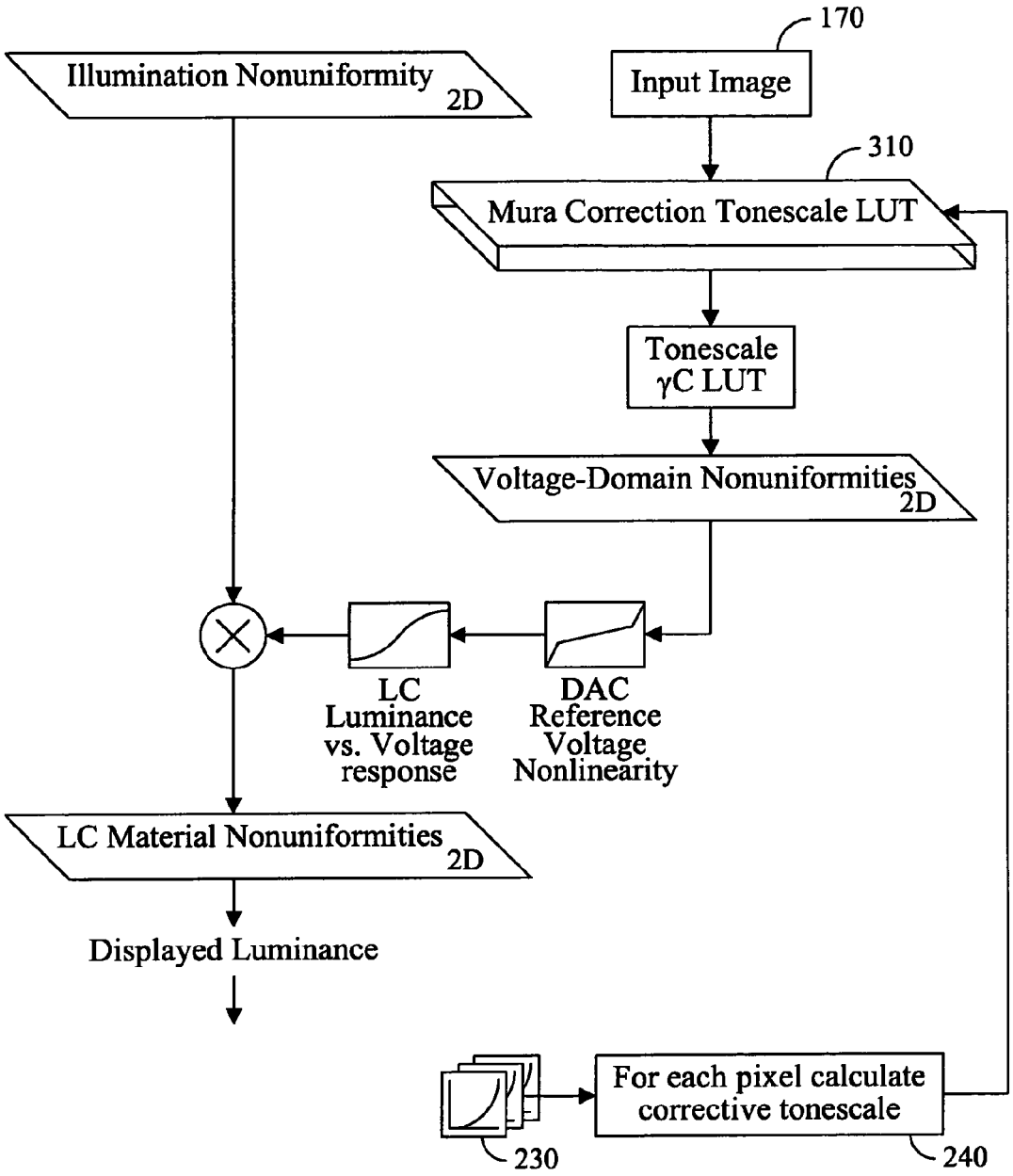
FIG. 3 illustrates loading correction mura tonescales.

In summary, referring to FIG. 2, the process of detecting and correcting for mura defects may be done as a set of steps. First for a uniform test input image 220, the capture and generation of the corrective tone scale 230, 240 is created which may be expressed in the form of a look up table. Second, referring to FIG. 3 the corrective tone scale may be applied to a mura look up table 310 which operates on the frame buffer memory of the display. Third, referring to FIG. 4, the display is used to receive image data 170 which is modified by the mura look up table 310, prior to being displayed on the display.

The first step may use an image capture device, such as a camera, to capture the mura as a function of gray level. The camera should have a resolution equal to or greater than the display so that there is at least one pixel in the camera image corresponding to each display pixel. For high resolution displays or low resolution cameras, the camera may be shifted in steps across the display to characterize the entire display. The preferable test patterns provided to and displayed on the display include uniform fields (all code values=k) and captured by the camera. The test pattern and capture are done for all of the code values of the displays tone scale (e.g., 256 code values for 8 bit/color display). Alternatively, a subset of the tone scales may be used, in which case typically the non-sampled tone values are interpolated.

Figure 4:
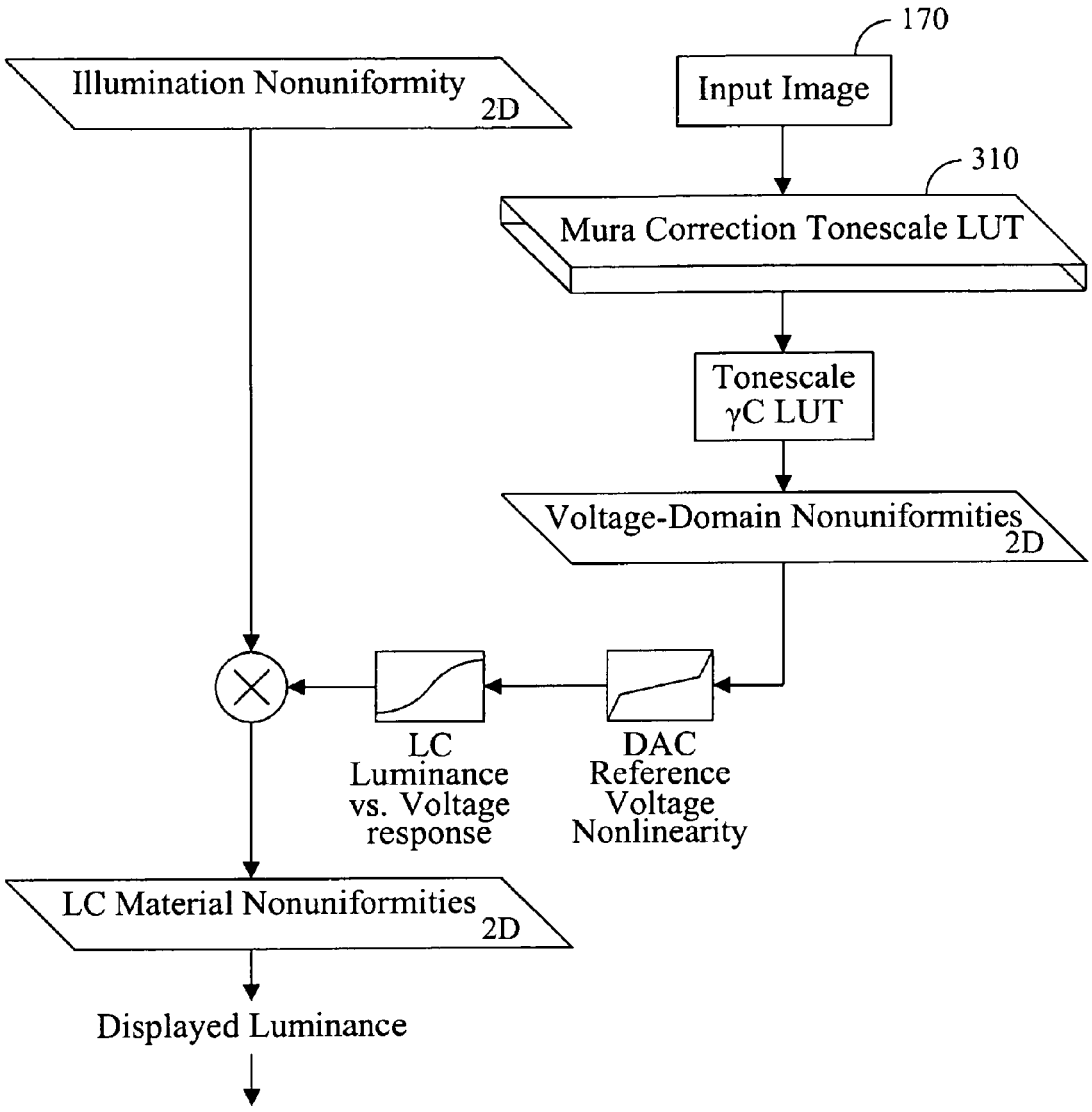
FIG. 4 illustrates input imagery and loaded mura correction tonescale.

The captured images are combined so that a tone scale across its display range is generated for each pixel (or a sub-set thereof). If the display has zero mura, then the corrective mura tone scales would all be the same. A corrective tone scale for each pixel is determined so that the combination of the corrective tone scale together with the system non-uniformity provides a resulting tone scale that is substantially uniform across the display. Initially, the values in the mura correction tone scale look up table may be set to unity before the display is measured. After determining the corrective mura tone scale values for each pixel, it is loaded into the display memory as shown in FIG. 4. With the mura corrective tone scale data loaded any flat field will appear uniform, and even mura that may be invisible on ramped backgrounds, such as a sky gradient, will be set to zero.

While this mura reduction technique is effective for reducing display non-uniformities, it also tends to reduce the dynamic range, namely, the maximum to minimum in luminance levels. Moreover, the reduction in the dynamic range also depends on the level of mura which varies from display to display, thus making the resulting dynamic range of the display variable. For example, the mura on the left side of the display may be less bright than the mura on the right side of the display. This is typical for mura due to illumination non-uniformity, and this will tend to be the case for all gray levels. Since the mura correction can not make a pixel brighter than its max, the effect of mura correction is to lower the luminance of the left side to match the maximum value of the darker side. In addition, for the black level, the darker right side can at best match the black level of the lighter left side. As a result, the corrected maximum gets reduced to the lowest maximum value across the display, and the corrected minimum gets elevated to the lightest minimum value across the display. Thus, the dynamic range (e.g., log max-log min) of the corrected display will be less than either the range of the left or right sides, and consequently it is lower than the uncorrected display. The same reduction in dynamic range also occurs for the other non-uniformities. As an example, a high amplitude fixed pattern noise leads to a reduction of overall dynamic range after mura correction.

The technique of capturing the mura from the pixels and thereafter correcting the mura using a look up table may be relatively accurate within the signal to noise ratio of the image capture apparatus and the bit-depth of the mura correction look up table. However, it was determined that taking into account that actual effects of the human visual system that will actually view the display may result in a greater dynamic range than would otherwise result.

By way of example, some mura effects of particular frequencies are corrected in such a manner that the changes may not be visible to the viewer. Thus the dynamic range of the display is reduced while the viewer will not otherwise perceive a difference in the displayed image. By way of example, a slight gradient across the image so that the left side is darker than the right side may be considered a mura effect. The human visual system has very low sensitivity to such a low frequency mura artifact and thus may not be sufficiently advantageous to remove. That is, it generally takes a high amplitude of such mura waveforms to be readily perceived by the viewer. If the mura distortion is generally imperceptible to the viewer, although physically measurable, then it is not useful to modify it.

Figure 5:
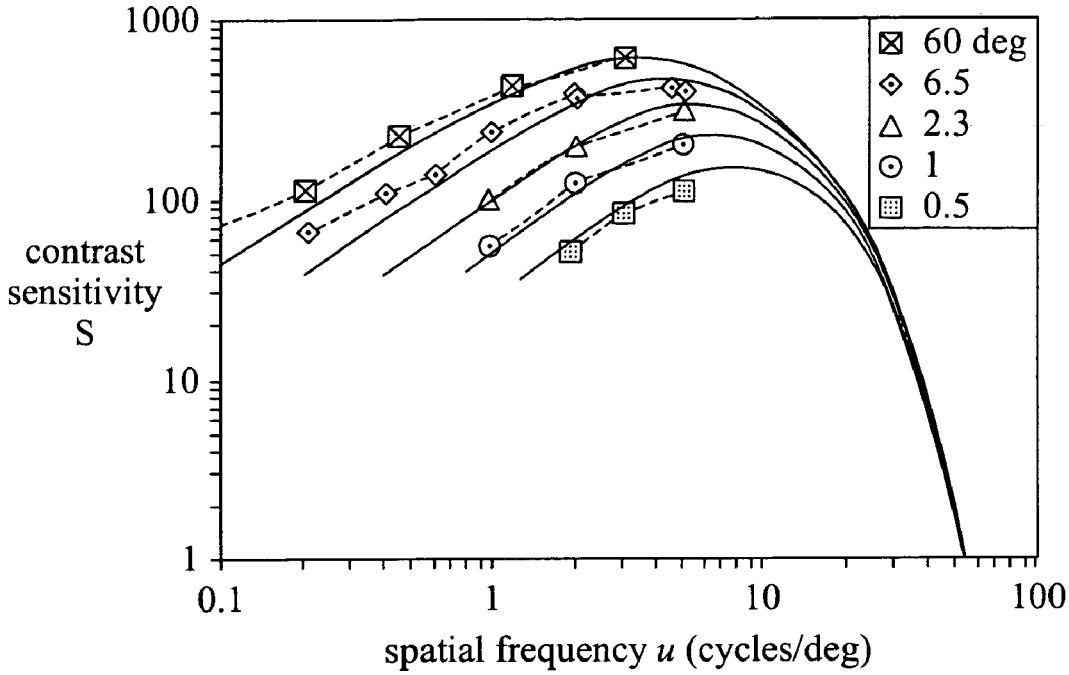
FIG. 5 illustrates contrast sensitivity function dependence on viewing angle.

Referring to FIG. 5, one measure of the human visual system is a contrast sensitivity function (CSF) of the human eye. This is one of several criteria that may be used so that only the mura that is readily visible to the eye is corrected. This has the benefit of maintaining a higher dynamic range of the correction than the technique illustrated in FIGS. 3-5.

The CSF of the human visual system as a function of spatial frequencies and thus should be mapped to digital frequencies for use in mura reduction. Such a mapping is dependent on the viewing distance. The CSF changes shape, maximum sensitivity, and bandwidth is a function of the viewing conditions, such as light adaptation level, display size, etc. As a result the CSF should be chosen for the conditions that match that of the display and its anticipated viewing conditions.

The CSF may be converted to a point spread function (psf) and then used to filter the captured mura images via convolution. Typically, there is a different point spread function for each gray level. The filtering may be done by leaving the CSF in the frequency domain and converting the mura images to the frequency domain for multiplication with the CSF, and then convert back to the spatial domain via inverse Fourier transform.

Figure 6:
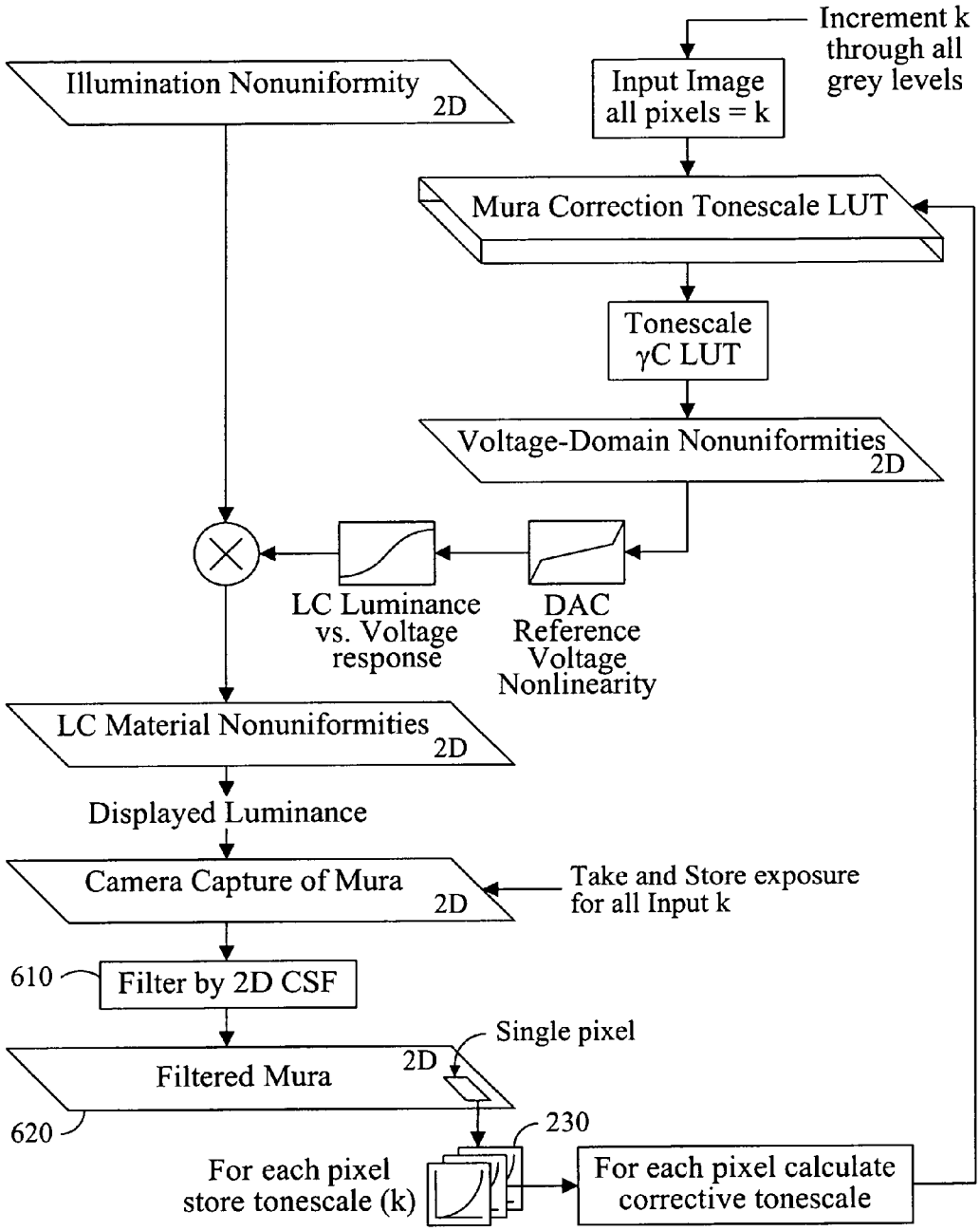
FIG. 6 illustrates a contrast sensitivity model to attenuate the mura correction to maintain a higher dynamic range.
Figure 7:
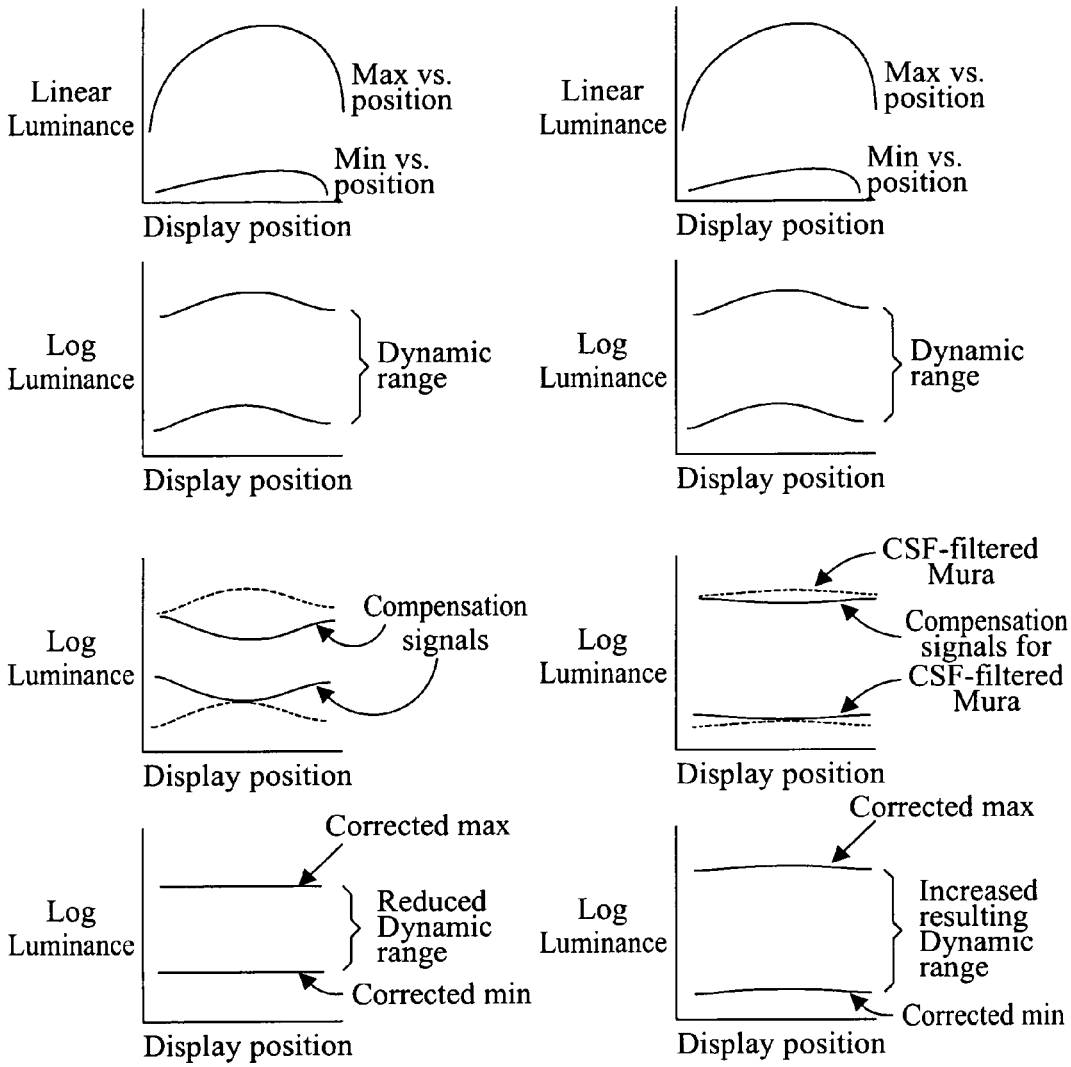
FIG. 7 illustrates examples of mura correction with and without using the contrast sensitivity model.

Referring to FIG. 6, a system that includes mura capture, corrective mura tone scale calculation, CSF filtered 610, 620, and mura correction tone scale look up table is illustrated. FIG. 7 illustrates the effects of using the CSF to maintain bandwidth.

Figure 8:
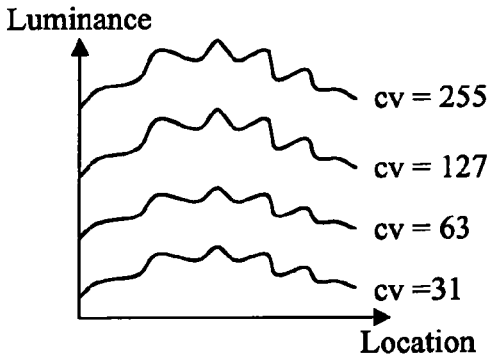
FIG. 8 illustrate an original luminance without correction.
Figure 9:
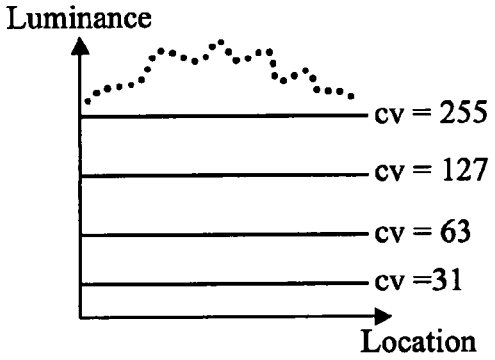
FIG. 9 illustrates brute-force mura correction.

It is possible to correct for mura distortions at each and every code value which would be approximately 255 different sets of data for 8-bit mura correction. Referring to FIG. 8, the luminance at each code value is illustrated for a selected set of code values across the display. In many displays, the luminance toward the edges of the display tend to be lower than the center of the display. This may be, in part, because of edge effects of the display. Referring to FIG. 9, a brute-force mura correction technique for each and every code value for all pixels of the display results in a straight line luminance for each code value across the display. It is noted that the resulting luminance for a particular code value is selected to be the minimum of the display. Accordingly, it was observed that in the event that a particular region of the display has values substantially lower than other regions of the display, the result will be a decrease in the luminance provided from the display for a particular code value, in order to have a uniform luminance across the display.

Figure 10:
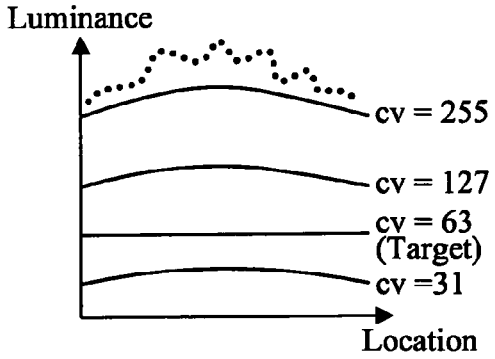
FIG. 10 illustrates single image mura correction.

Referring to FIG. 10, to increase the dynamic range for portions of the display, it is desirable to determine a mura correction for a particular code value, such as code value 63. Thus at code value 63 the resulting mura across the display will be corrected or substantially corrected. The mapping used to correct for code value 63 is then used at the basis for the remaining code values to determine an appropriate correction. The resulting code values will tend to result in arched mura correction curves. The resulting curved mura curves result in an increase in the dynamic range of regions of the display while displaying values in a manner that are difficult to observe mura defects.

In some cases, it is desirable to determine a mura correction for a particular code value, such as code value 63, that includes a curve as the result of filtering. The filtering may be a low pass filter, and tends to be bulged toward the center. The curved mura correction tends to further preserve the dynamic range of the display. The curved mura correction may likewise be used to determine the mura correction for the remaining code values.

It is to be understood, that the mura correction may further be based upon the human visual system. For example, one or more of the mura curves that are determined may be based upon the human visual system. Moreover, the low pass filtered curve may be based upon the human visual system. Accordingly, any of the techniques described herein may be based in full, or in part, on the human visual system.

The memory requirements to correct for mura for each and every gray level requires significant computational resources. Additional approaches for correcting mura are desirable. One additional technique is to use a single image correction technique that uses fewer memory resources, and another technique is to use a multiple image correction technique which uses fewer memory resources with improved mura correction. The implementation of the conversion from the original input images to mura corrected output images should be done in such a manner that enables flexibility, robustness, and realizes efficient creation of corrected output images by using interpolation.

The single image correction is a mura correction technique that significantly reduces the memory requirements. Comparing with brute-force correction, single image correction corrects the mura of just only one gray level (e.g. cv=63 in FIGS. 4, 5, 6) instead of every gray level of the brute-force correction. Brute-force correction intends to correct every gray level for all pixels. FIG. 9 shows only several gray levels for simplicity of illustration.

Figure 11:
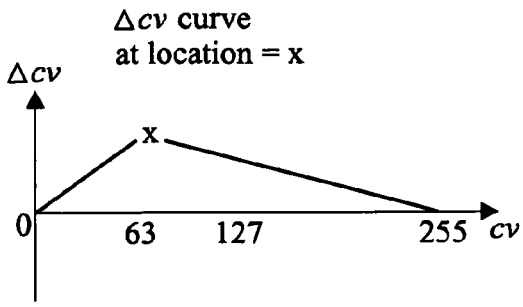
FIG. 11 illustrates a delta curve for a single image mura correction.
Figure 12:
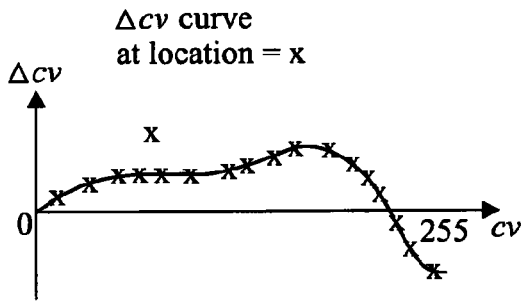
FIG. 12 illustrates a delta curve for a brute force mura correction.

In particular, in single image correction the correction code value (Acv) of other gray levels without the target to correct are determined by interpolation assuming Δcv=0 at gray level is 0 (lower limitation) and 255 (upper limitation) because mura of intermediate gray levels is more visible, as illustrated in FIG. 11. The other hand, brute-force method calculates the correction code value of all of gray levels, theoretically speaking, as illustrated in FIG. 12. In some cases, it is desirable to also provide white mura correction (Δcv=255), in addition to intermediate grey levels, to provide increased uniformity.

Figure 13:
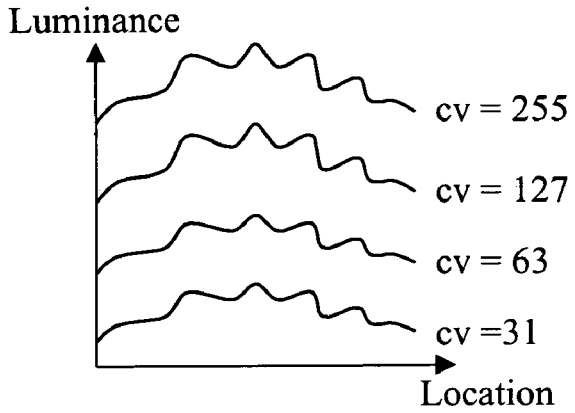
FIG. 13 illustrates original luminance without correction.
Figure 14:
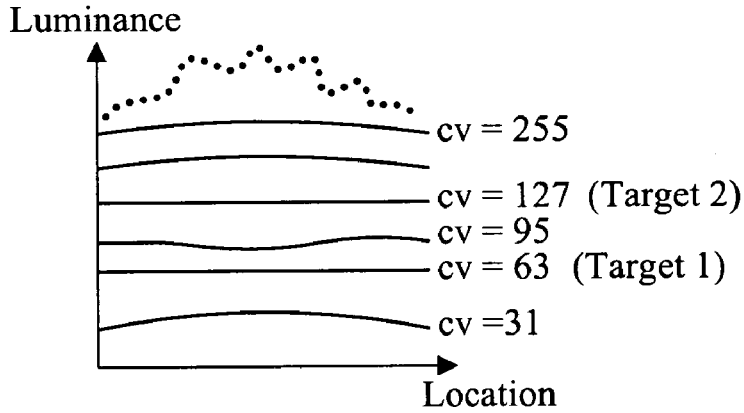
FIG. 14 illustrates multiple image mura correction.

In some cases, to provide more accurate mura correction while maintaining the dynamic range and limiting the storage requirements, a multiple mura correction technique may be used. Compared with brute-force correction, multiple image correction corrects the mura based upon several gray levels (e.g. cv=63 and 127), as illustrated in FIGS. 13 and 14.

Figure 15:
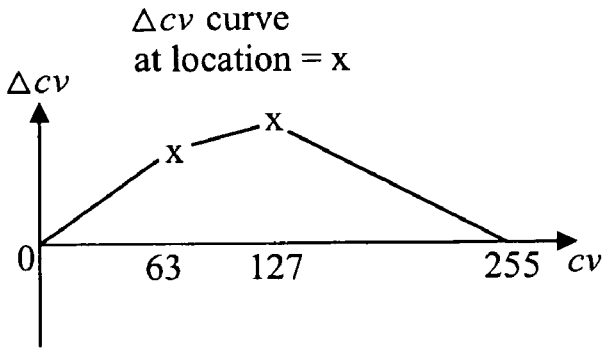
FIG. 15 illustrates a delta curve for multiple image mura correction.

Referring to FIG. 15, in multiple image correction, the correction code value (Δcv) of other non-target gray levels are determined by interpolation assuming Δcv=0 at gray level 0 (lower limitation) and 255 (upper limitation) because mura of intermediate gray level is more visible. Once the Δcv of the target gray levels are determined by using one of the proposed techniques, such as brute-force, single image, multiple image, and HVS-based correction, input images to display can be corrected by reference of LUT and interpolation as illustrated in FIG. 16.

Figure 16:
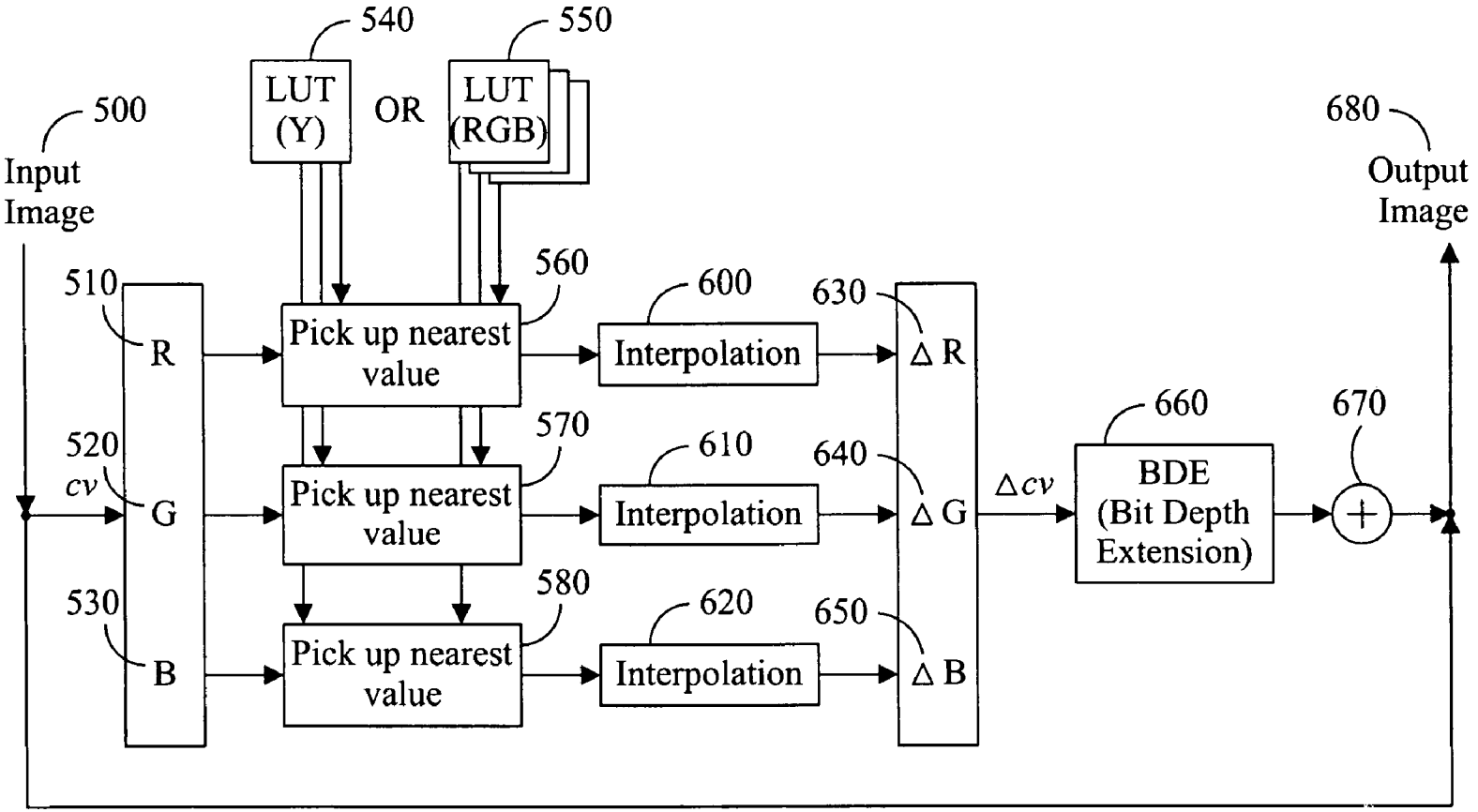
FIG. 16 illustrates a block diagram for mura correction.

Referring to FIG. 16, the mura correction system is flexible for implementation because the image processing does not depend on characteristics of each panel. Also, the system has the capability to adapt to other mura correction techniques. The input image 500 may be separated by color planes into R 510, G 520, and B 530. A luminance look up table 540 or a color dependant look up table 550 may be used to select near code values 560, 570, 580 within the respective look up table for the respective pixel. The selected code values are interpolated 600, 610, 620, to determine an interpolated code value. The interpolated code values 600, 610, 620 are then used for determining 630, 640, 650 the adjustment for the respective pixel. It is to be understood that other suitable color spaces may likewise be used, such as for example, YUV, HSV. A bit depth extension process 660 may be used, if desired. The output of the bit depth extension process 660 is added 670 to the input image 500 to provide a mura corrected output image 680. Bit depth extension may be any one of several techniques described in patents by Daly, assigned to Sharp Laboratories of America.

Color mura correction aims to correct non uniformity of color by using color based LUT. The same correction techniques (e.g. brute-force, HVS based, single image, multiple image) are applicable to using color mura LUT. The primary difference between luminance mura correction and color mura correction is to use colored gray scale (e.g. (R, G, B)=(t, 0, 0), (0, t, 0), (0, 0, t)) for capturing images. If the display is RGB display, the data size is 3 times larger than the luminance correction data. By correcting each color factor separately can achieve not only luminance mura correction but also color mura correction.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

We claim:

1. A method for correcting a display having a plurality of mura defects previously identified using a test if said display, said method comprising:

(a) at least one gray level being provided to a plurality of pixels of said display;

(b) said display illuminating each of said pixels with said at least one gray level;

(c) said display applying correction curve data for said pixels using a nonlinear correction curve that assumes $\Delta cv=0$ at maximum and minimum code values, to reduce the mura for those identified mura defects generally visible by the human visual system and not to reduce the mura for those identified mura defects generally not visible by the human visual system.

2. The method of claim 1 wherein said corrective data is based upon a weighting function that emphasizes a mid-range over a low range and a high range.

3. The method of claim 1 wherein the dynamic range of said image displayed on said display is greater than it would have otherwise been had the characteristics generally not visible by the human visual system been considered.

4. The method of claim 1 wherein interpolation is based upon a data set for a single grey level.

5. The method of claim 1 wherein interpolation is based upon a data set for a plurality of grey levels.

6. The method of claim 5 wherein said plurality of grey levels is less than all available grey levels.

7. The method of claim 1 wherein interpolation is based upon different data sets for different colors.

8. The method of claim 1 wherein said mura correction is generally lower toward the sides and higher toward the center of the display.

9. The method of claim 1 wherein said gray levels include less than all of the tone scale of said display.

10. The method of claim 9 wherein fewer tone scales of the lower range of said tone scale are used than the higher scales of said tone scale.

11. A display comprising:

(a) a processor providing at least one gray level to a plurality of pixels of said display;

(b) an illuminator illuminating each of said pixels with said at least one gray level;

(c) said processor applying interpolative correction curve data for said pixels so as to reduce the mura effects of said display, said interpolative corrective data retrieved from a look-up table where said processor interpolates corrections at one input code value to a display from one or more other code values to said display using a nonlinear said correction curve that assumes $\Delta cv=0$ at maximum and minimum code values.

12. The display of claim 11 wherein said correction curve data is based upon a weighting function that emphasizes a mid-range over a low range and a high range.

13. The display of claim 11 wherein the dynamic range of said image displayed on said display is greater than it would have otherwise been had the characteristics generally not visible by a human visual system been considered.

14. The display of claim 11 wherein interpolation is based upon a data set for a single grey level.

15. The display of claim 11 wherein interpolation is based upon a data set for a plurality of grey levels.

16. The display of claim 15 wherein said plurality of grey levels is less than all available grey levels.

17. The display of claim 11 wherein interpolation is based upon different data sets for different colors.

18. The display of claim 11 wherein said correction curve data is generally lower toward the sides and higher toward the center of the display.

19. The display of claim 11 wherein said gray levels include less than all of the tone scale of said display.

20. The display of claim 19 wherein fewer tone scales of the lower range of said tone scale are used than the higher scales of said tone scale.

* * * * *